US007277860B2

(12) United States Patent
Srinivas et al.

(10) Patent No.: US 7,277,860 B2
(45) Date of Patent: Oct. 2, 2007

(54) MECHANISM FOR USING CLAMPING AND OFFSET TECHNIQUES TO ADJUST THE SPECTRAL AND WIDEBAND GAINS IN THE FEEDBACK LOOPS OF A BTSC ENCODER

(75) Inventors: Hosahalli Srinivas, Irvine, CA (US); Gopal Venkatesan, Aliso Viejo, CA (US); Erik Berg, Laguna Beach, CA (US); Amy Hundhausen, Laguna Beach, CA (US)

(73) Assignee: Broadcom Corporation, Irvine, CA (US)

( * ) Notice: Subject to any disclaimer, the term of this patent is extended or adjusted under 35 U.S.C. 154(b) by 789 days.

(21) Appl. No.: 10/784,690

(22) Filed: Feb. 23, 2004

(65) Prior Publication Data

US 2005/0038664 A1 Feb. 17, 2005

Related U.S. Application Data

(60) Provisional application No. 60/495,508, filed on Aug. 14, 2003.

(51) Int. Cl.
*G10L 21/00* (2006.01)

(52) U.S. Cl. ..... 704/500; 704/501

(58) Field of Classification Search ..... 704/500, 704/501
See application file for complete search history.

(56) References Cited

U.S. PATENT DOCUMENTS

| | | | | |
|---|---|---|---|---|
| 7,103,555 | B2 * | 9/2006 | Fuchigami et al. | 704/501 |
| 2004/0013272 | A1 * | 1/2004 | Reams | 381/1 |
| 2007/0025566 | A1 * | 2/2007 | Reams | 381/98 |

* cited by examiner

*Primary Examiner*—Daniel Abebe
(74) *Attorney, Agent, or Firm*—Garlick Harrison & Markison; Bruce E. Garlick

(57) ABSTRACT

An integrated digital BTSC encoder substantially implemented on a single CMOS integrated circuit is described. By saturating and adding offsets to the value of the feedback control signal in regions of operation where the calculation for the control signal is dominated by noise, an integrated circuit selectively adjusts the control signal for the spectral or wideband feedback loop, as required, so that the performance of a very low noise digital BTSC encoder complies with the requirements of the BTSC standard.

28 Claims, 9 Drawing Sheets

800

900

MECHANISM FOR USING CLAMPING AND OFFSET TECHNIQUES TO ADJUST THE SPECTRAL AND WIDEBAND GAINS IN THE FEEDBACK LOOPS OF A BTSC ENCODER

RELATED APPLICATIONS

This patent application claims priority from U.S. Provisional Patent Application Ser. No. 60/495,508, entitled "Mechanism for Using Clamping and Offset Techniques to Adjust the Spectral and Wideband Gains in the Feedback Loops of a BTSC Encoder" filed on Aug. 14, 2003.

BACKGROUND OF THE INVENTION

1. Field of the Invention

The present invention is directed in general to receivers and transmitters for stereophonic audio signals for use in television and cable broadcasting. In one aspect, the present invention relates to a method and system for digitally encoding audio signals used in the broadcast of stereophonic cable and television signals in the United States and in other countries. In a further aspect, the present invention provides an integrated circuit system for digital BTSC stereo encoding.

2. Related Art

In 1984, the Federal Communications Commission (FCC) adopted a standard for the audio portion of television signals called Multichannel Television Sound (MTS) Transmission and Audio Processing Requirements for the BTSC System—OET-60, which permitted television programs to be broadcast and received with bichannel audio, e.g., stereophonic sound. Similar to the definition of stereo for FM radio broadcast, MTS defined a system for enhanced, stereo audio for television broadcast and reception. Also known as BTSC stereo encoding (after the Broadcast Television System Committee (BTSC) that defined it) the BTSC transmission methodology is built around the concept of companding, which means that certain aspects of the incoming signal are compressed during the encoding process. A complementary expansion of the signal is then applied during the decoding process.

The original monophonic television signals carried only a single channel of audio. Due to the configuration of the monophonic television signal and the need to maintain compatibility with existing television sets, the stereophonic information was necessarily located in a higher frequency region of the BTSC signal, making the stereophonic channel much noisier than the monophonic audio channel. This resulted in an inherently higher noise floor for the stereo signal than for the monophonic signal. The BTSC standard overcame this problem by defining an encoding system that provided additional signal processing for the stereophonic audio signal. Prior to broadcast of a BTSC signal by a television station, the audio portion of a television program is encoded in the manner prescribed by the BTSC standard, and upon reception of a BTSC signal, a receiver (e.g., a television set) then decodes the audio portion in a complementary manner. This complementary encoding and decoding insures that the signal-to-noise ratio of the entire stereo audio signal is maintained at acceptable levels.

FIG. 1 is a block diagram of the front end portion of an analog BTSC encoding system 100, as defined by the BTSC standard. Encoder 100 receives left and right channel audio input signals (indicated in FIG. 1 as "L" and "R", respectively) and generates a conditioned sum signal and an encoded difference signal. It should be appreciated that, while the system of the prior art and that of the present invention is described as useful for encoding the left and right audio signals of a stereophonic signal that is subsequently transmitted as a television signal, the BTSC system also provides means to encode a separate audio signal called SAP (Second Audio Program), e.g., audio information in a different language, which is separated and selected by the end receiver. Further, noise reduction components of the BTSC encoding system can be used for other purposes besides television broadcast, such as for improving audio recordings.

System 100 includes an input section 110, a sum channel processing section 120, and a difference channel processing section 130. Input section 110 receives the left and right channel audio input signals and generates a sum signal (indicated in FIG. 1 as "L+R") and a difference signal (indicated in FIG. 1 as "L−R"). It is well known that for stereophonic signals, the sum signal L+R may be used by itself to provide monophonic audio reproduction and it is this signal that is decoded by existing monophonic audio television sets to reproduce sound. In stereophonic receivers, the sum and difference signals can be added to and subtracted from one another to recover the original two stereophonic signals (L) and (R). Input section 110 includes two signal adders 112, 114. Adder 112 sums the left and right channel audio input signals to generate the sum signal, and adder 114 subtracts the right channel audio input signal from the left channel audio input signal to generate the difference signal.

To accommodate transmission path conditions for television broadcasts, the difference signal is subjected to additional processing than that of the sum signal so that the dynamic range of the difference signal can be substantially preserved as compared to the sum signal. More particularly, the sum channel processing section 120 receives the sum signal and generates the conditioned sum signal. Section 120 includes a 75 μs preemphasis filter 122 and a bandlimiter 124. The sum signal is applied to the input of filter 122 which generates an output signal that is applied to the input of bandlimiter 124. The output signal generated by the latter is then the conditioned sum signal.

The difference channel processing section 130 receives the difference signal and generates the encoded difference signal. Section 130 includes a fixed preemphasis filter 132 (shown implemented as a cascade of two filters 132*a* and 132*b*), a variable gain amplifier 134 preferably in the form of a voltage-controlled amplifier, a variable preemphasis/deemphasis filter (referred to hereinafter as a "variable emphasis filter") 136, an overmodulation protector and bandlimiter 138, a fixed gain amplifier 140, a bandpass filter 142, an RMS level detector 144, a fixed gain amplifier 146, a bandpass filter 148, an RMS level detector 150, and a reciprocal generator 152. The processing of the difference signal ("L−R") by the section 130 is substantially as described in the Background section of U.S. Pat. No. 5,796,842 which explains that the BTSC standard rigorously defines the desired operation of the 75 μs preemphasis filter 122, the fixed preemphasis filter 132, the variable emphasis filter 136, and the bandpass filters 142, 148, in terms of idealized analog filters. Specifically, the BTSC standard provides a transfer function for each of these components and the transfer functions are described in terms of mathematical representations of idealized analog filters. The BTSC standard further defines the gain settings, Gain A and Gain B, of amplifiers 140 and 146, respectively, and also defines the operation of amplifier 134, RMS level detectors 144, 150, and reciprocal generator 152. The BTSC standard also provides suggested guidelines for the operation of overmodulation protector and bandlimiter 138 and bandlimiter 124. Specifically, bandlimiter 124 and the bandlimiter portion of overmodulation protector and bandlimiter 138 are described as low-pass filters with cutoff frequencies of 15 kHz, and the overmodulation protection portion of overmodulation protector and bandlimiter 138 is described as a threshold device that limits the amplitude of the encoded difference signal to 100% of full modulation where full modulation is the maximum permissible deviation level for modulating the audio subcarrier in a television signal.

In the past, BTSC stereo encoders and decoders were implemented using analog circuits. Through careful calibration to tables and equations described in the BTSC standard, the encoders and decoders could be matched sufficiently to provide acceptable performance. However, conventional analog BTSC encoders (such as described in U.S. Pat. No. 4,539,526) have been replaced by digital encoders because of the many benefits of digital technology. Prior attempts to implement the analog BTSC encoder 100 in digital form have failed to exactly match the performance of analog encoder 100. This difficulty arises from the fact that the BTSC standard defines all the critical components of idealized encoder 100 in terms of analog filter transfer functions, and prior digital encoders have not been able to provide digital filters that exactly match the requirements of the BTSC-specified analog filters. As a result, conventional digital BTSC encoders (such as those described in U.S. Pat. Nos. 5,796,842 and 6,118,879) have deviated from the theoretical ideal specified by the BTSC standard, and have attempted to compensate for this deviation by deliberately introducing a compensating phase or magnitude error in the encoding process.

Given the processing capabilities of current signal processors, digital implementions of a BTSC encoder can result in the opposite problem of too much accuracy when the digital solution is capable of a far higher signal-to-noise ratio than the analog solution. In this case, the digital encoder does not provide satisfactory performance in regions of operation where noise dominates the operation of the two feedback loops. The result is a degradation in the performance of the encoding/decoding system and reduced stereo separation for the encoded signal.

In addition to the complexity of the computational requirements for encoding the stereo signals, such as described above, the ever-increasing need for higher speed communications systems imposes additional performance requirements and resulting costs for BTSC encoding systems. In order to reduce costs, communications systems are increasingly implemented using Very Large Scale Integration (VLSI) techniques. The level of integration of communications systems is constantly increasing to take advantage of advances in integrated circuit manufacturing technology and the resulting cost reductions. This means that communications systems of higher and higher complexity are being implemented in a smaller and smaller number of integrated circuits. For reasons of cost and density of integration, the preferred technology is CMOS. To this end, digital signal processing ("DSP") techniques generally allow higher levels of complexity and easier scaling to finer geometry technologies than analog techniques, as well as superior testability and manufacturability.

There is a need to provide a digital encoding system for processing stereophonic audio signals in compliance with an audio encoding standard that provides accurately encoded audio signals. Conventionally known systems have attempted to compensate for magnitude or phase errors created by imprecise digital filtering, or have suffered from degraded performance in low frequency operations where the digital encoder has a higher signal-to-noise ratio than the BTSC-specified analog decoder. Further, the nature of existing analog BTSC encoders has made them inconvenient to use with digital equipment such as digital playback devices. A digital BTSC encoder could accept the digital audio signals directly and could therefore be more easily integrated with other digital equipment. Therefore, there is a need for a better system that is capable of performing the above functions and overcoming these difficulties without increasing circuit area and operational power. Further limitations and disadvantages of conventional systems will become apparent to one of skill in the art after reviewing the remainder of the present application with reference to the drawings and detailed description which follow.

SUMMARY OF THE INVENTION

In accordance with the present invention, an integrated circuit system and method are provided for digitally encoding stereophonic audio signals in accordance with the BTSC standard. In a selected embodiment, an improved digital difference channel processing section is provided for adjusting the control signal for the spectral feedback loop to improve the matching between a very low noise digital BTSC encoder and an analog BTSC decoder. Generally speaking, noise matching may be provided by injecting digital noise corresponding to the analog noise contained in the analog BTSC decoding process. Control signal adjustments are provided by selectively saturating and then adding offsets to the value of the spectral feedback loop's control signal as calculated using standard equations. These adjustments are only added in regions of operation where the calculation for the control signal is dominated by noise. The same principle can be applied to the wideband feedback loop.

In a selected embodiment, a digital BTSC signal encoder is provided for encoding first and second digital audio signals (e.g., Left and Right stereo audio signals). The encoder is constructed with digital filters and operates at a high sample rate so that digital filters in the sum and difference channels substantially match the analog filter transform functions specified in the BTSC standard in both magnitude and phase. In a selected embodiment, the encoder operates at a sample rate of approximately at least ten times the bandwidth of the signal being encoded (for example, at least approximately 150-200 kHz in an audio encoding application) so that said digital filters in the sum channel processor and the difference channel processor substantially match BTSC analog filter transform functions in both magnitude and phase. An input section of the encoder receives the first and second digital audio sections and generates a digital sum signal and a digital difference signal. The digital difference signal is digitally processed by a difference channel processor which includes a spectral compressor and a spectral feedback loop. The feedback loop generates a spectral gain control signal that is used to generate a first control signal. The first control signal directly or indirectly controls the spectral compressor to improve the matching between a very low noise digital BTSC encoder and an analog BTSC decoder. Control signal adjustments are provided by selectively saturating and then adding offsets to the value of the spectral feedback loop's control signal as calculated using standard equations. These adjustments are only added in regions of operation where the calculation for the control signal is dominated by noise. For example, the first control signal may be clamped so that it does not go below a minimum value at low frequencies for the control signal. In addition or in the alternative, the first control signal may be offset from the spectral gain control signal by a first offset value. In addition or in the alternative, the first offset value tapers off as the first control signal exceeds a first threshold value. In addition or in the alternative, the first offset value includes a ramp offset value or triangular offset value when the first control signal is between a first threshold value and a second threshold value.

In a selected embodiment, the encoder includes an input matrix that receives the first and second digital audio signals and uses an adder to sum the first and second digital audio signals to generate a digital sum signal. The input matrix also uses a subtractor to subtract the second digital audio signal from the first digital audio signal to generate a digital difference signal. In addition, the input matrix may include low-pass filters for filtering the input digital audio signals, where the low-pass filters are characterized by a cutoff frequency that is less than or equal to substantially 15-20 kHz and by a stop-band attenuation of substantially 50-70 dB, preferably approximately 60 dB of attenuation. The digital sum signal is digitally processed by a sum channel processor that includes a first digital filter, such as a preemphasis filter. The difference channel processor includes a second digital filter, such as a fixed preemphasis filter, variable emphasis filter, bandlimit filter or bandpass filters. With the present invention, the digital BTSC signal encoder may be formed as a CMOS integrated circuit on a single silicon substrate.

The objects, advantages and other novel features of the present invention will be apparent from the following detailed description when read in conjunction with the appended claims and attached drawings.

DETAILED DESCRIPTION

Figure 1:
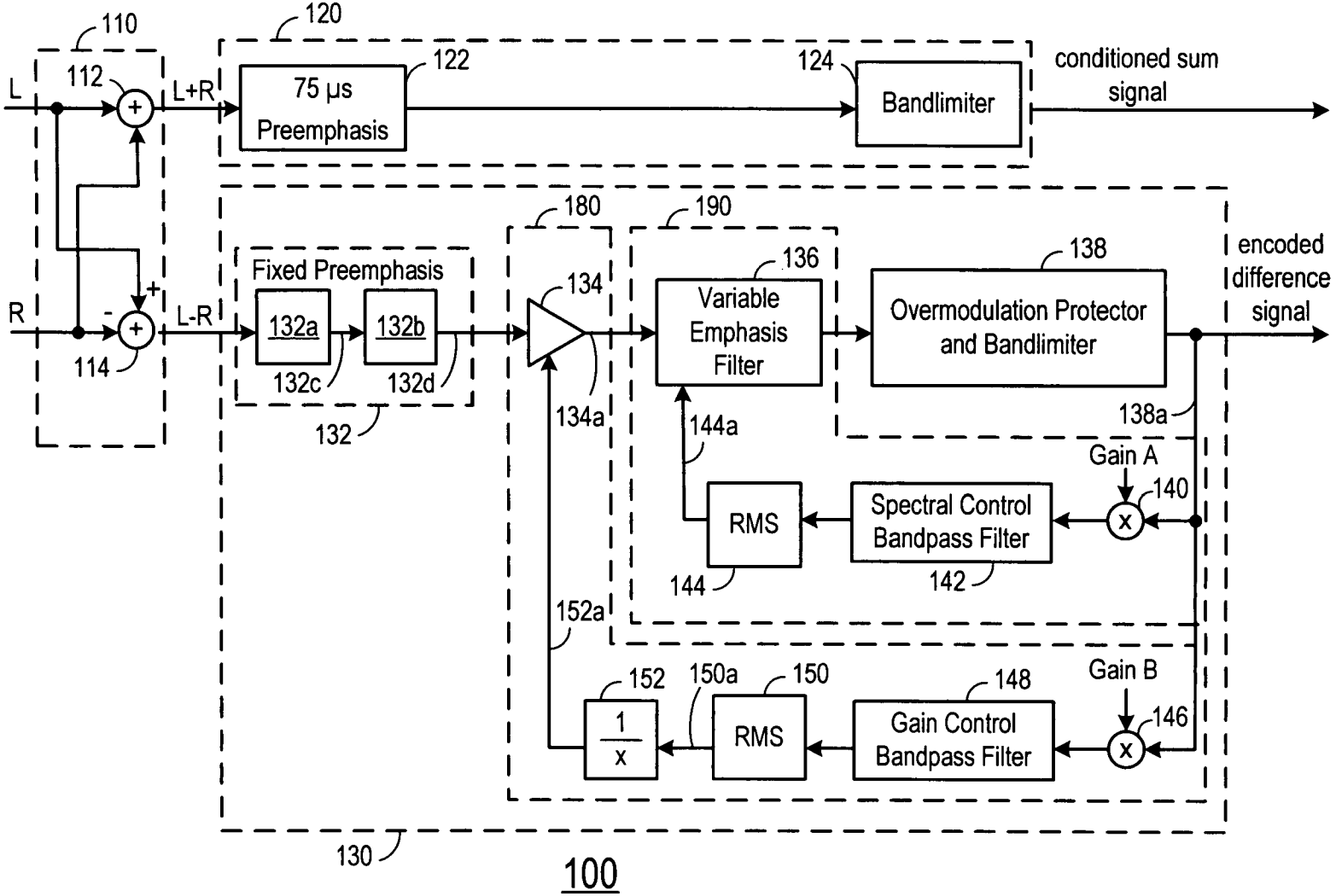
FIG. 1 shows a block diagram of a prior art analog BTSC encoder.
Figure 2:
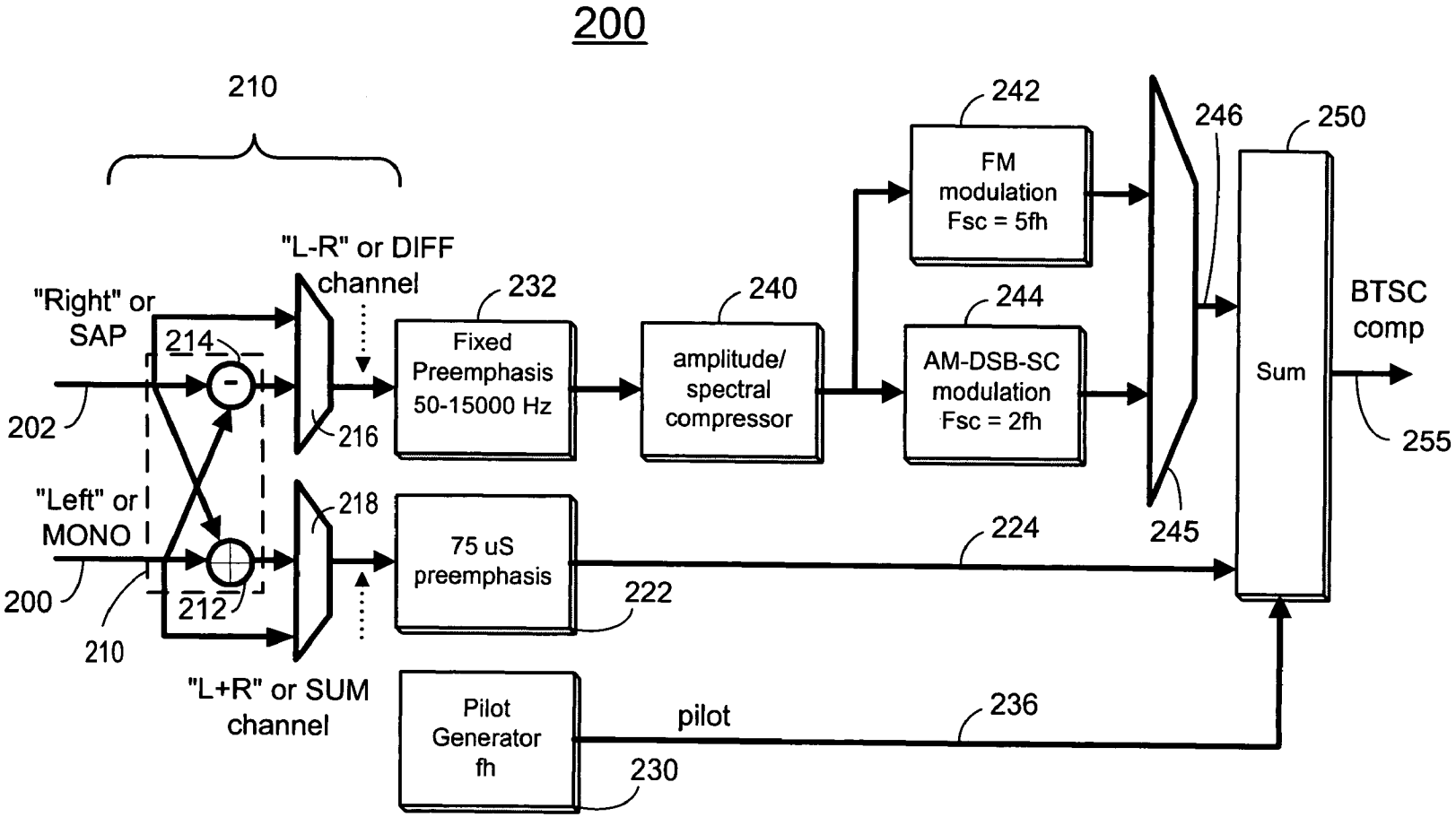
FIG. 2 depicts a system level description of a BTSC encoder.
Figure 4:
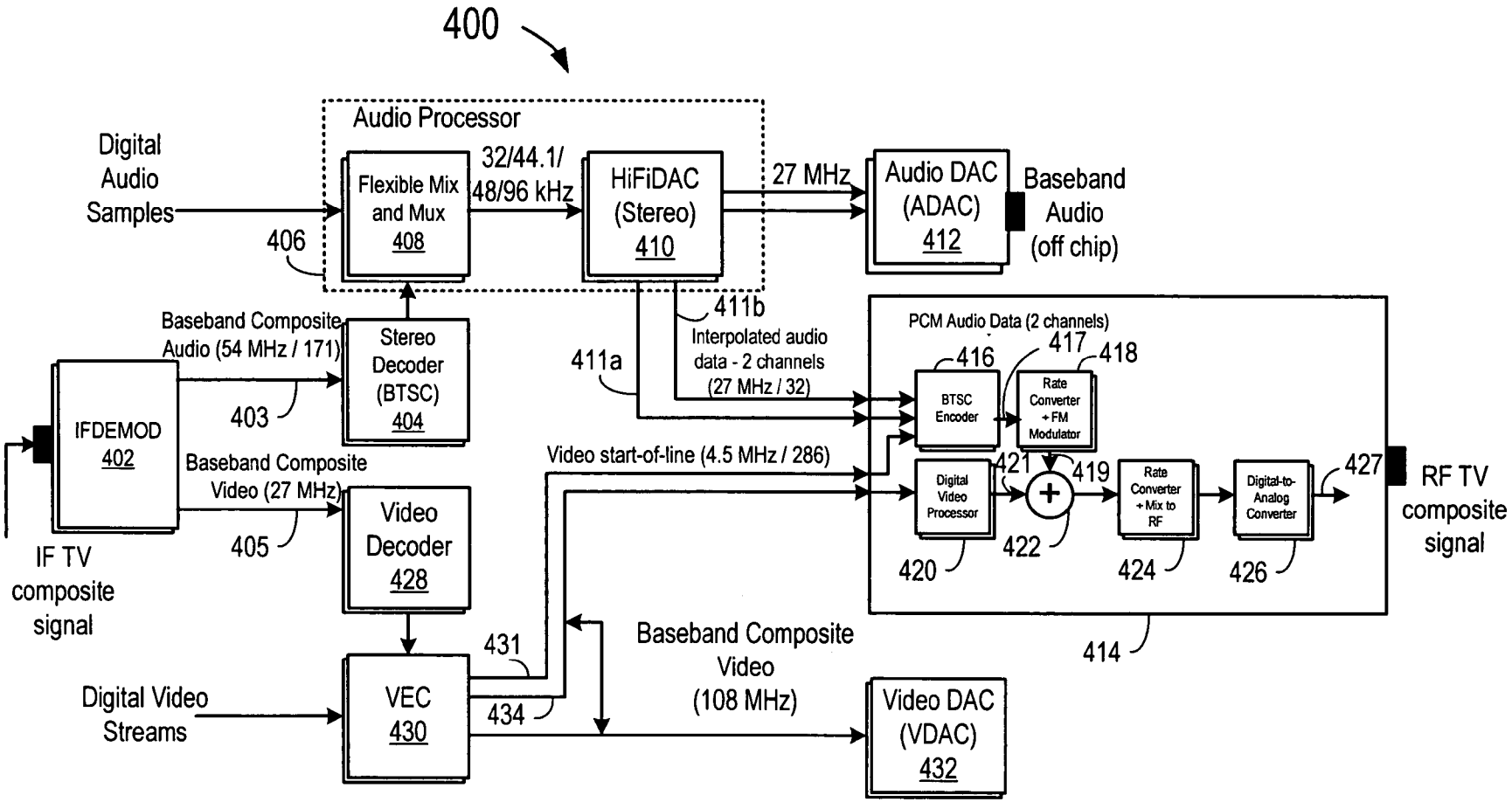
FIG. 4 is a diagram illustrating an application of the present invention in the RFM unit of a set-top box chip.

An apparatus and method in accordance with the present invention provide a system for digitally encoding stereo signals in accordance with the BTSC standard. A system level description of the operation of an embodiment of the BTSC encoder of the present invention is shown in FIG. 2 which depicts a diagram of a digital BTSC encoder 200. As depicted in FIG. 2, the output of encoder 200 is a BTSC compliant signal which includes stereo and SAP functionality for stereo encoding, advantageously sharing an amplitude/spectral compressor circuit 240 to thereby reduce the circuit size. It will be appreciated that the encoder of the present invention may also be implemented to provide the professional channel encoding specified by the BTSC standard, or may otherwise output a baseband BTSC multiplex signal at output 255. As will be appreciated, the BTSC encoder of the present invention has many potential applications. For example, the BTSC encoder may be included as part of an RF modulator core (RFM) in a television set-top box device that converts a NTSC/PAL/SECAM compliant digital composite video source and a pulse code modulated (PCM) audio source into an analog composite television signal that is suitable for demodulation by a television demodulator. A block diagram of an example is shown in FIG. 4 (discussed below), which depicts an application of the present invention in the RFM unit of a set-top box chip. In this application, the baseband BTSC composite signal 255 is fed to a FM modulator that modulates the aural carrier, and the resulting signal is then summed with a baseband composite video signal. The combined audio/video signal is mixed to a RF frequency, converted to analog form and sent off chip.

In connection with the system level description of FIG. 2, when monophonic (MONO) audio processing is desired, the Left and Right channels of the input stereo audio signal 200, 202 are summed (in a summer 212) and passed to a 75 μsecond preemphasis filter 222. This datapath is considered to be the SUM channel. The 75 μsecond preemphasis filter 222 provides extra gain to the high-frequency components. The output of the preemphasis filter 222 is passed directly to the summing device 250. The other two inputs to the final summation 250 in the BTSC encoder 200, which are the DIFF channel output 246 and the pilot tone 236, are zeroed out. Note that the SUM channel is sometimes referred to as the L+R channel, and the DIFF channel is sometimes referred to as the L−R channel.

When SAP (secondary audio program) processing is desired in the encoder of FIG. 2, the monophonic SAP signal replaces the "Right" audio input channel. The BTSC encoder first sharply bandlimits the SAP audio input stream to 10 kHz using a low-pass filter (not shown). The resulting signal is passed through the DIFF channel to a fixed preemphasis filter 232 whose characteristics are defined in the FCC OET-60 document. The output of this filter 232 is passed to spectral compressor module 240. The output of spectral compressor module 240 FM modulates a carrier sine wave whose frequency is five times the pilot rate of 15.734 kHz.

When dual monophonic (DUAL MONO) operation is desired, a monophonic audio signal replaces the "Left" audio input channel, and the SAP signal replaces the "Right" audio input channel. Thus, the main monophonic signal is transmitted through the SUM channel at the same time that the SAP signal is transmitted through the DIFF channel. Note that in this case, the left audio input 200 and the right SAP input 202 bypass the adder 212 and subtractor 214 and pass through the multiplexers 216 and 218 to the SUM channel and DIFF channel.

Stereo processing is very similar to dual monophonic processing. In the encoder of FIG. 2, an input section 210 receives the left and right channel audio input signals and generates therefrom a sum signal and a difference signal. A signal addition device 212 produces the SUM (L+R) channel based on the sum of the Left and Right channels of the input stereo audio signal. A signal subtraction device 214 produces the DIFF (L−R) channel based on the difference between the Left and Right channels of the input stereo audio signal. It will be appreciated that a matrix functionality may be used to receive the digital left and digital right signals and to generate the digital sum signal and digital difference signal. The SUM channel is passed through the 75 μsecond preemphasis filter 222, and the DIFF channel is passed through the fixed preemphasis filter 232 and the amplitude/spectral compressor module 240. The output of amplitude/spectral compressor 240 is passed to the AM-DSB-SC (Double side band suppressed carrier amplitude modulator) block 244, where it amplitude modulates a sine wave carrier whose frequency (31,468 Hz) is equal to twice that of the pilot tone (15,734 Hz). The output of encoder 200 is a BTSC composite signal 255 that is used to FM modulate the aural carrier.

The output 246 of this modulator along with 224 and 236 is passed to the sum block 250 that produces the BTSC composite signal 255.

Figure 3:
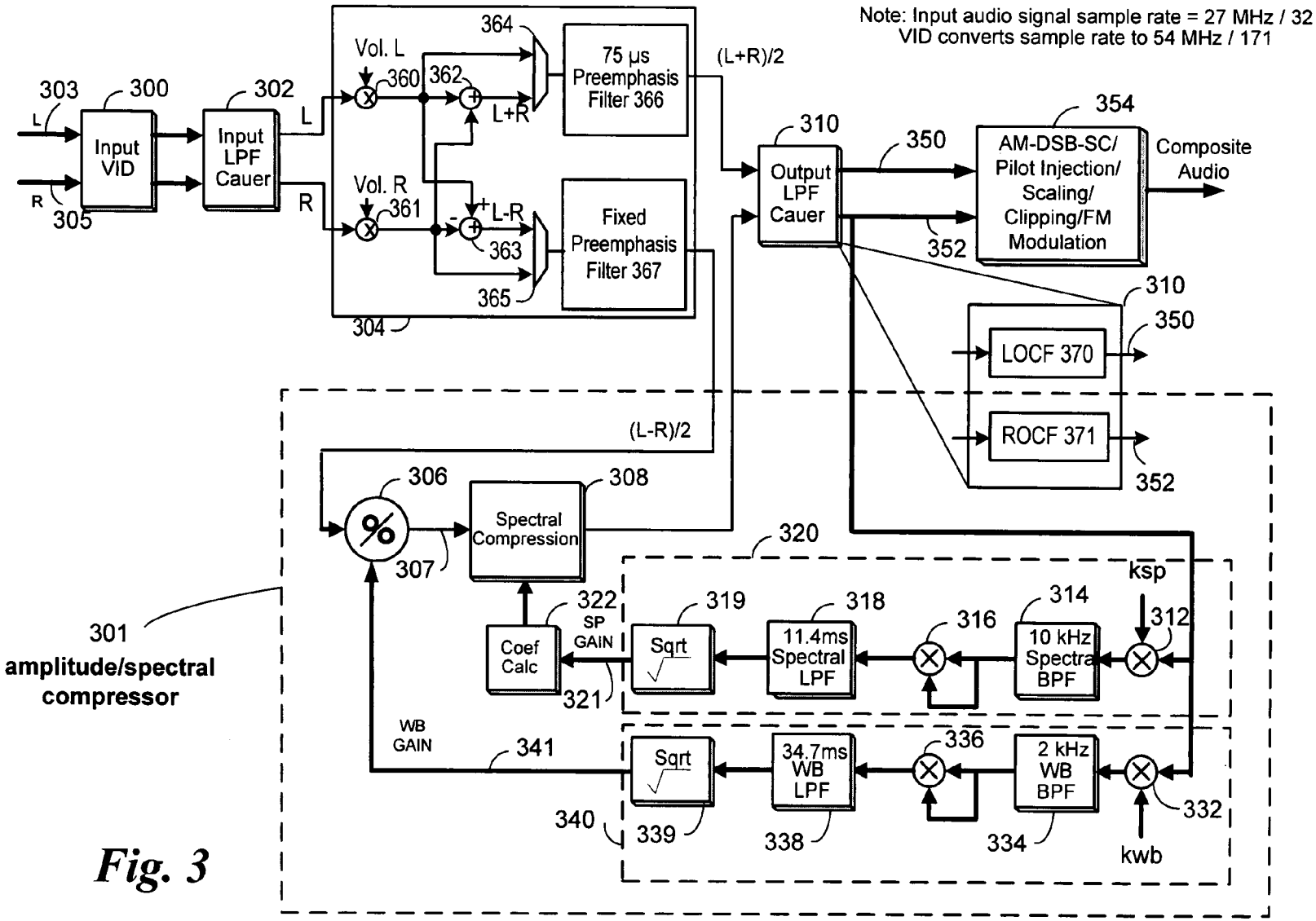
FIG. 3 depicts a block diagram of an alternate embodiment showing additional details of a BTSC encoder in accordance with the present invention.

FIG. 3 depicts a block diagram of an alternate embodiment showing additional details of an amplitude and spectral compressor. The difference channel processor consists of the fixed preemphasis filter 367, the compressor 301 and the right output Cauer filter 371 (a low pass filter). The compressor 301 is composed of the wideband gain loop and the spectral gain loop. The wideband gain loop is a loop formed by the following components: 306, 308, 371, and 340. The spectral gain loop is a loop formed by the components 308, 371, 320, and 322. The wideband RMS detectors 340 and the spectral RMS detectors 320 monitor the compressor output 352 and produce the wideband gain (WB GAIN 341) and the spectral gain (SP GAIN 321), respectively. The wideband gain is used to control the wideband amplifier 306, which is essentially a divider. Using a clamp or saturator in the WB gain path (e.g., in block 339), the divider output 307 is saturated to the maximum or minimum value (depending upon the sign of the input) if the wideband gain 341 reaches a minimum threshold value. A similar clamping technique may be used in the spectral gain loop to control the spectral gain value (SP GAIN 321) that is used to compute the coefficients of the spectral compressor 308 using the coefficient calculator 322, on-the-fly. Three divide operations are required to calculate the coefficients and these are also performed on-the-fly in the coefficient calculator 322.

Another way of viewing the difference channel processor shown in FIG. 3 is that the amplitude/spectral compressor module 301 is essentially a wideband gain stage 306 that is followed by a variable preemphasis filter, or spectral compressor, 308. The wideband gain stage 306 is controlled by the WB GAIN signal 341 through the wideband gain loop or feedback path. The spectral compressor 308 is controlled by the SP GAIN signal 321 through the spectral gain loop or feedback path. As depicted, the feedback paths of the BTSC encoder begin at the output 352 of the right low-pass Cauer filter ROCF 371. These feedback paths are used to control the wideband divider 306 and spectral compressor 308. The spectral feedback path control signal is based on the RMS power that passes through a bandpass filter 314 with a 10 kHz center frequency. The wideband feedback path control signal is based on the RMS power that passes through a bandpass filter 334 with a 2 kHz center frequency. When the input signal to the BTSC encoder is a low frequency signal, the feedback paths are dominated by noise because the signal lies outside the passband of the bandpass filters 314, 334.

As indicated in FIG. 3, the BTSC encoder receives two 18-bit audio channel inputs (L 303 and R 305). To allow proper digital processing of the signals, the encoder should operate at a minimum rate of about ten times the signal bandwidth, e.g., 150-200 kHz. The choice of the sampling rate is driven by the need for the digital filter implementations to more closely match the analog filter transform functions (specified by the BTSC standard) in both magnitude and phase. A sample rate of 316 kHz results in good matching of the magnitude and phase responses between the analog and digital domains so that no phase compensation is needed in the encoding process. In a selected embodiment, two channel inputs 303, 305 which arrive at a first sample rate (e.g., 27 MHz/32) are converted to a second sample rate (e.g., 54 MHz/171) by the input VIDs (Variable Rate Interpolator Decimator) 300.

The input streams to the encoder are filtered by low-pass Cauer filters 302 to limit the bandwidth of signals for BTSC standard system compliance. For MONO mode of operation (with stereo and SAP turned off), the two audio inputs may be programmably limited to approximately 15-20 kHz. For STEREO mode of operation, the two audio inputs may be limited to approximately 15 kHz. For MONO/SAP mode of operation, the input 303 for audio channel 1 may be limited to approximately 15-20 kHz while the input 305 for audio channel 2 may be limited to approximately 10 kHz. This low-pass filtering operation is achieved by reprogramming the coefficients to the input low-pass Cauer filters 302 for each mode of operation. By designing the input low-pass Cauer filters 302 to have sharp transition bands, emphasis of noise outside of the audio bands is prevented during the encoding operation. By providing input filters with stop-band attenuation of substantially 50-70 dB, good rejection of the input out-of-band noise after the preemphasis is provided.

In the encoding system, output low-pass Cauer filters 370, 371 reduce the high-frequency out-of-band noise that is amplified by the 75 μsecond preemphasis filters 366, 367, 306 and 308. The resulting filtered digital sum signal 350 and filtered digital difference signal 352 may be processed, programmably scaled, clipped and frequency modulated in the modulator block 354. Modulator 354 is used to inject the pilot subcarrier that is frequency locked to the horizontal scanning frequency of the transmitted video signal, as required by the MTS OET-60 standard. In addition, AM-DSB-SC modulation may be implemented in modulator 354 for modulating the output 352.

As referenced above, the BTSC encoder 416 (see FIG. 4) of the present invention may be included in a variety of applications, such as the RF Modulator core (RFM 414) depicted in FIG. 4 for generating the RF TV composite signal that is used by a set-top box to generate channel 3/4 (or such) output signal(s) 427. In the depicted embodiment, RFM 414 converts a NTSC/PAL/SECAM compliant digital composite video source 434 and a pulse code modulated (PCM) audio source 411*a*, 411*b* into an analog composite television signal 427 that is suitable for demodulation by a television demodulator. Moreover, the audio source may be stereo encoded according to the BTSC standard. In a single chip integrated circuit embodiment of the present invention, a digital BTSC encoder 416 is disclosed for encoding stereo audio signals 411*a, b*, where the encoder 416 is integrated as part of a single chip set-top box 400 fabricated with CMOS technology. Upon integration into a set-top box chip 400, the present invention reduces board level components, thereby reducing costs and improving performance over prior art approaches. Thus, the present invention shows, for the first time, a fully integrated digital BTSC encoder 416 that may be implemented in CMOS as part of a single chip set-top box 400.

The block diagram in FIG. 4 shows the various operations to be performed in the RFM 414, as well as the primary datapath input and output signals. As depicted in the context of a set-top box chip shown in FIG. 4, the RFM 414 can be considered to be a part of the audio/video back end. A simplified drawing of part of a set-top box is depicted in FIG. 4 with a focus on the operations performed for an analog television channel.

In a selected embodiment, the set-top box chip may contain blocks that perform the inverse functions to the RFM. Thus, a IFDEMOD block 402 demodulates an analog composite IF television signal and produces a digital baseband composite video signal 405 and a digital baseband audio signal 403 (either monophonic or BTSC baseband multiplex). By exchanging data between the RFM 414 and IFDEMOD 402, both can be co-verified on the system bench using an all-digital interface. This exchange of data is referred to as a "loopback mode" and may be used for test functions. The purpose of the loopback mode from the IFDEMOD 402 to the RFM 414 is to allow the audio and video data that is associated with an analog television channel to "pass through" the chip without requiring any encoding or decoding.

The primary audio source for the RFM 414 is the High Fidelity DAC 410 (HiFiDAC) that is part of the audio processor 406. As shown, BTSC decoder 404 receives the baseband composite audio signal 403 and generates a decoded audio signal for the mixer 408. HiFiDAC 410 provides two channels (411*a*, 411*b*) of pulse code modulated (PCM) audio data to the RFM 414. The primary video source for the RFM 414 is the video encoder 430 (VEC) which receives digital video stream data from the video decoder 428. VEC 430 provides the NTSC, PAL, or SECAM encoded digital baseband composite video signal 434 that accompanies the HiFiDAC's audio signal. VEC 430 also provides a video start-of-line signal 431 that allows the RFM to lock its audio subcarriers to the video line rate.

In terms of the audio/video backend functionality of the set-top box chip 400, the RFM 414 includes a digital audio processor portion (416, 418), a digital video processor portion (420) and a digital audio/video processor portion (422, 424, 426). The digital audio processor portion includes the BTSC encoder 416 and rate converter with FM modulator 418. The RFM 414 accepts four input signals, including three input signals for the BTSC encoder 416 which are expected to be employed in normal operation and a baseband composite video input signal 434. The first two BTSC encoder input signals are two channels of audio PCM data 411*a*, 411*b*. The third BTSC encoder input signal is the video start-of-line signal 431, which is used to synchronize the pilot tone needed for BTSC encoding to the video line rate. The BTSC encoded audio is combined with the video data at adder 422 at the digital audio/video processor and then rate converted, mixed to RF (424) and converted from digital to analog format (426) to generate the RF TV composite output signal 427. In a selected embodiment, the digital video 421 and FM modulated audio 419 signals are converted and mixed at block 424 to a programmable carrier frequency that may be chosen from 0 to 75 MHz, which includes NTSC channels 2, 3 and 4. In order to maintain reasonable separation of the spectral images in the analog output of the digital-to-analog converter, the DAC 426 is clocked with as high a clock rate as possible.

The original MTS standard (as described in the FCC document OET-60) specifies a BTSC encoder and a BTSC decoder in terms of analog filter components. Implementing a BTSC encoder or a decoder digitally can most easily be achieved by realizing digital filter structures obtain by using bilinear transform techniques for realizing analog filters/functions digitally. Digital filter structures implemented using bilinear transform cannot properly transmit high frequency signals (signals whose bandwidth approaches the sample rate) without phase distortion. In order to avoid this limitation of bilinear transforms, a very high sampling rate is employed for the BTSC encoder. In one embodiment of the digital BTSC encoder, a sample rate of 54 MHz/171 (that is approximately 315.789 kHz) is chosen to transmit signals whose bandwidth does not extend beyond 20 kHz. Alternatively, by choosing a sampling rate that is twice as large as the highest frequency of interest, the bilinear transform techniques can be used to derive digital filters with small frequency response displacement. In an embodiment of the present invention implementing a BTSC encoder, a sampling rate of at least 200 kHz allows bilinear transform techniques to be used to design the digital filter that closely matches the BTSC encoder analog filter functions in both amplitude and phase.

Because analog and digital circuits fundamentally have different noise characteristics, the low frequency stereo separation for a digital encoder can be substantially improved by adjusting/compensating the spectral gain 321, which is the control signal that is input to the spectral compressor's coefficient calculator 322. These adjustments are designed to account for the increased noise that is typically found in an analog system relative to a digital system, and can substantially improve the low frequency stereo separation for a digital encoder. The benefits of such a compensation technique are more easily observed by having a digital BTSC encoder driving an analog BTSC decoder (that closely conforms to the OET-60 standard). The digital output from the digital encoder may be made to drive a digital-to-analog converter. The output of the converter can drive the analog BTSC encoder. As will be appreciated, the adjustments to the control signal can be performed by spectral compressor's coefficient calculator 322, or can be implemented by other adjustment circuitry connected to the input of the spectral compressor 308 or calculator 321. These adjustments are designed to account for differing amounts of noise energy found in an analog system relative to a digital system. The SP GAIN 321 (as well as the WB GAIN 341) is the exponentially time-weighted root-mean-square value of the signal energy found in a particular band of audio frequencies. In the lower frequency band (i.e., below 1.2 kHz), the signal energy detected by the spectral and wideband gain RMS detectors is comparable to the noise energy. For illustration purposes, a spectral gain compensation is described here. In the spectral gain RMS detector, for low frequency regions, the contributions by the noise energy to SP GAIN 321, when compared with the signal energy, are significant. Therefore, any difference in the noise characteristics between an encoder and a decoder can result in differing values for the computed SP GAIN 321. This mismatch leads to degraded stereo-separation.

In accordance with the present invention, stereo separation at low frequencies can be improved by selectively adjusting the SP GAIN signal 321, using a variety of techniques such as described herein. In one embodiment, a minor or adjustable offset is added to the spectral gain only if the spectral gain is below a certain threshold value. With this offset, stereo separation is improved for most frequencies. However, minor stereo separation jitter appears at the frequencies where the spectral gain oscillates about the maximum comparison point. Such jitter can be in terms of minor amplitude and phase variation for a single frequency.

An alternative embodiment of the present invention helps control the jitter in the separation by rolling off or tapering the offset value when the spectral gain is above a maximum comparison point. Tapering the offset addresses the situation where the comparator is adding an offset value for spectral gain that is noisy and that fluctuates about a comparison point for a single tone going through the compressor.

Figure 5:
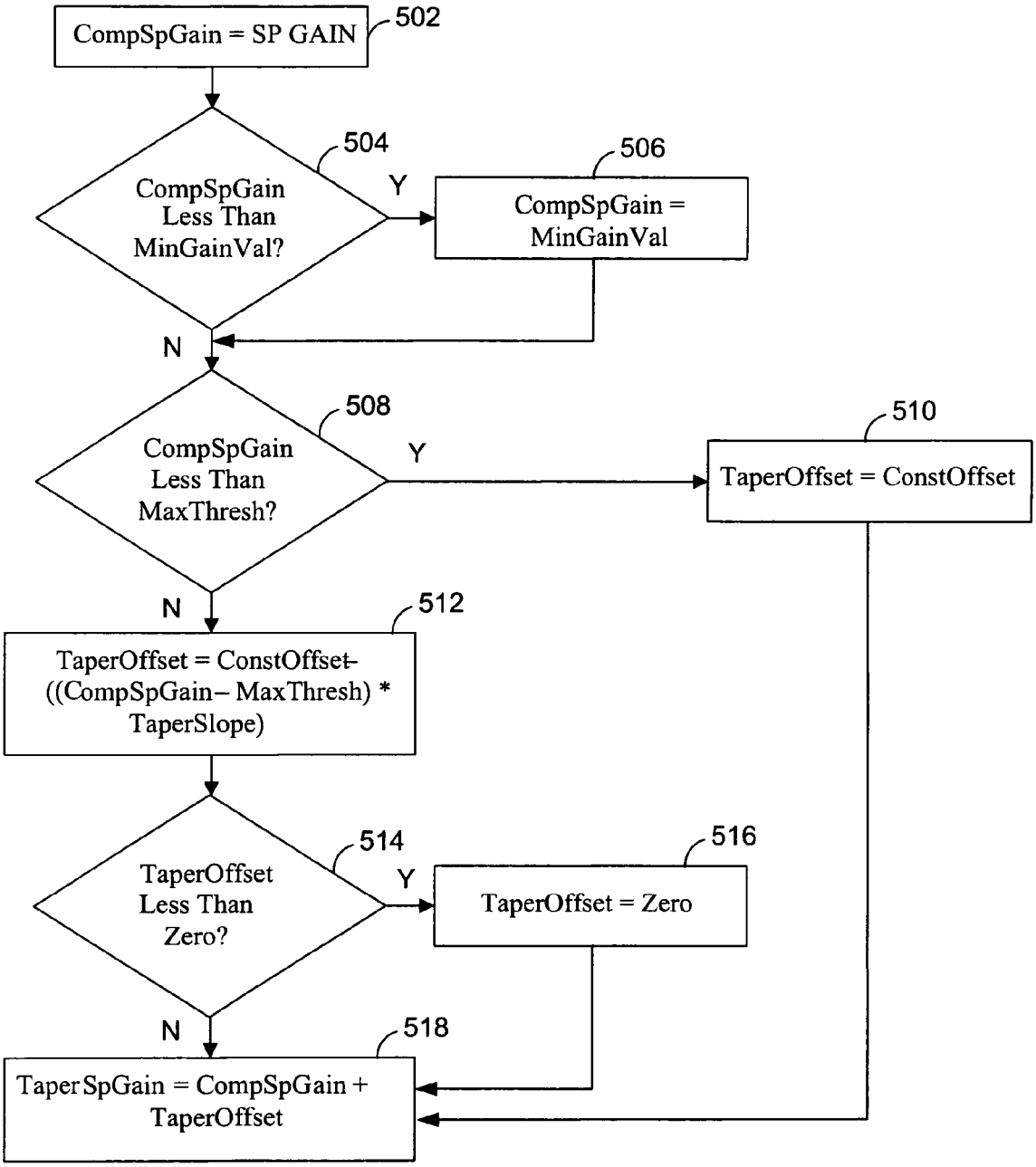
FIG. 5 depicts a process flow for adjusting a gain control signal by clamping and tapering an offset adjustment.

In a selected embodiment, a tapered offset and clamp technique is provided whereby an adjusted or computed value for the spectral gain (CompSpGain) is determined by setting (or "clamping" to) a minimum value (MinGainVal) that is allowed for the spectral gain and by adding constant offset value (ConstOffset) for certain values of clamped spectral gain (i.e., spectral gain with the MinGainVal as the minimum allowed value) and is tapered off as the computed value exceeds a threshold level. An exemplary illustration of the tapered offset and clamp technique is depicted in FIG. 5, which shows a series of calculations to be performed at each sample clock for adjusting the computed value for the spectral gain (SP GAIN 321) to generate a final value for the spectral gain (TaperSpGain) control signal after the tapered offset (TaperOffset) is added. In a selected embodiment, the final TaperSpGain value is applied to the coefficient calculator 322 of the amplitude/spectral compressor module 301.

As illustrated in the flowchart of FIG. 5, a minimum clamped value is assigned to the output of the RMS detector in the spectral gain feedback loop at blocks 502, 504, 506 by assigning the value of the RMS detector signal output (SP GAIN) as the computed spectral gain value (CompSpGain) at step 502, and then setting this value to a minimum (or clamped) value (MinGainVal) that is allowed for the spectral gain at steps 504, 506.

Next, the clamped computed spectral gain value (CompSpGain) is adjusted by adding an adjustment value (TaperOffset), where the adjustment value rolls off to the extent (CompSpGain) exceeds a threshold value (MaxThresh). As depicted in FIG. 5, if the clamped computed spectral gain value (CompSpGain) is below the threshold value (as determined at step 508), then a constant offset value (ConstOffset) may be added to the clamped computed spectral gain value (CompSpGain), as shown at steps 510 and 518. However, if the clamped computed spectral gain value (CompSpGain) exceeds the threshold value (as determined at step 508), the adjustment value (TaperOffset) is tapered off. The tapering calculation can be implemented in any of a variety of ways, but as shown at step 512, tapering is accomplished by subtracting from the constant offset value (ConstOffset) the product of the slope with which the ClampSpGain is tapered off (TaperSlope) and the difference between the clamped computed spectral gain value (CompSpGain) and the threshold value (MaxThresh). The tapered value (TaperOffset) is set to a minimum value of zero (steps 514, 516), and is then added to the clamped computed spectral gain value (CompSpGain), as shown at step 518, to generate the final value for the spectral gain control signal (TaperSpGain).

As will be appreciated, various techniques and algorithms can be used to generate and adjust final gain control signal waveform (TaperSpGain). For example, instead of implementing the offset tapering when the computed spectral gain value (CompSpGain) meets the maximum threshold, as shown at step 518, tapering can begin when the final gain control signal waveform (TaperSpGain) meets a threshold level. As will be appreciated, the closer the value of the maximum threshold (MaxThresh) is to the value of the minimum gain value (MinGainVal) plus the constant offset (ConstOffset), the sooner the tapering of the taper offset value (TaperOffset) begins so that it matches the computed spectral gain value (CompSpGain). These are but illustrative examples of using tapered clamping to restrict the control signal (whether for the spectral compressor or the wideband gain stage) from having values at low frequencies where noise would otherwise dominate the operation of the feedback loops. As described herein, the clamping and tapering adjustment to the gain control signal is designed to account for differing amounts of noise energy found in an analog system relative to a digital system In an alternative embodiment, an additional offset is employed in conjunction with the tapered offset technique described herein. In a selected embodiment, the stereo separation performance can be improved by employing a triangular offset which improves the effects of the offset and clamping operations in the transition region where the computed value for the spectral gain (CompSpGain) approaches the clamping threshold. In effect, the triangular offset adds a ramped offset value (RampOffset or RO) to the computed value for the spectral gain before the TaperOffset is calculated. The resulting overall adjustment is described with reference to FIG. 6, which shows a series of calculations to be performed at each sample clock for adjusting the computed value for the spectral gain (SP GAIN 321) using an example of the triangular offset technique. As illustrated, a triangular offset value (RO) is added to the computed spectral gain value, where the value of the triangular offset value depends on the extent to which the computed spectral gain value exceeds predetermined threshold values.

Figure 6:
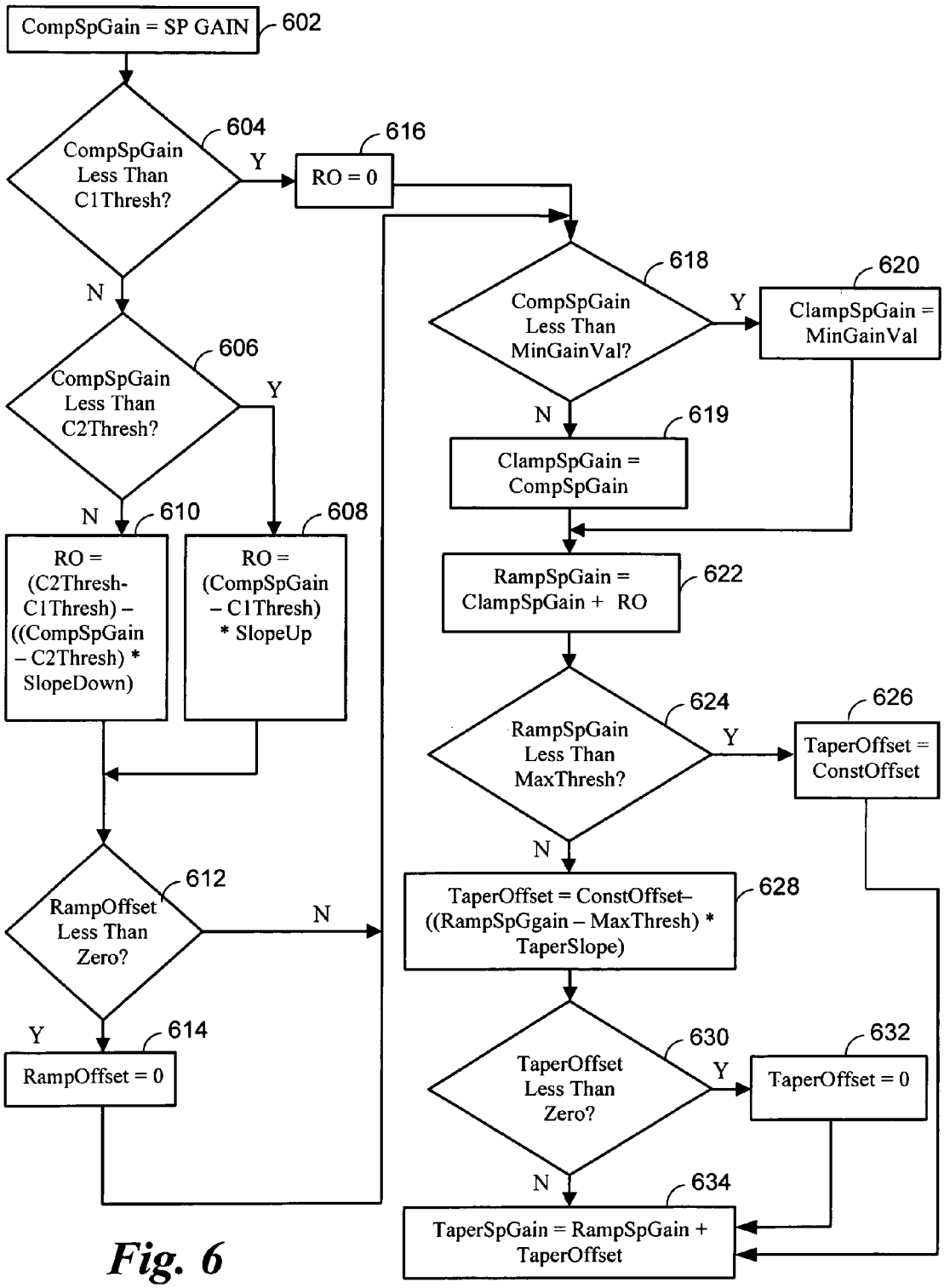
FIG. 6 depicts a process flow for an alternative compensation technique that adjusts a gain control signal by ramping the offset value with a triangular offset technique.

As depicted in FIG. 6, the triangular offset value (RO) is assigned a value of zero (step 616) if the computed spectral gain amplitude (CompSpGain) is less than a first predetermined threshold amplitude (C1Thresh) (decision 604). As the computed spectral gain (amplitude) increases above the first predetermined threshold (amplitude), the triangular ramp offset value (RO) ramps up from the zero value to larger values (see step 608). In a selected embodiment, the first predetermined threshold is smaller than the minimum gain value (MinGainVal) that is allowed for the spectral gain. The ramping of the RO value is shown at step 606, which determines if the computed spectral gain value (CompSpGain) is between the first predetermined threshold (C1Thresh) and a second predetermined threshold (C2Thresh), which is the value above which the triangular ramp offset value (RO) is ramped down from its peak value. In a selected embodiment, the second predetermined threshold is larger than the minimum gain value (MinGainVal) that is allowed for the spectral gain. If the computed spectral gain value is less than the second predetermined threshold, the triangular ramp offset value is determined at step 608 to be the product of a first transition value SlopeUp (for use when the triangular offset value RO is ramping up to larger values) and the difference between the computed spectral value (CompSpGain) and the first predetermined threshold (C1Thresh).

On the other hand, if the computed spectral gain value is larger than the second predetermined value (C2Thresh), the triangular ramp offset value is determined at step 610 with the following equation:

$$RO=(C2\text{Thresh}-C1\text{Thresh})-((\text{Comp}Sp\text{Gain}-C2\text{Thresh})*\text{SlopeDown})$$

The value of rampoffset (RO) is reduced from a maximum value of (C2Thresh−C1Thresh) by a value of (CompSpGain−C2Thresh)*(CompSpGain−C2Thresh)*SlopeDown for a value of CompSpGain greater than C2Thresh.

The triangular offset value (RO) is set to a minimum value of zero (steps 612, 614).

A minimum clamped value (ClampSpGain) is assigned to the output of the RMS detector in the spectral gain feedback loop at blocks 618, 620 by assigning the value of the RMS detector signal output (SP GAIN) as the computed spectral gain value (CompSpGain) at step 602, and then setting the ClampSpGain value to a minimum amplitude value (MinGainVal) that is allowed for the spectral gain at steps 618, 620. The triangular offset value (RO) is then added to the clamped spectral gain value (ClampSpGain) to generate RampSpGain, the spectral gain signal after clamping and after the addition of the triangular offset value, as shown at step 622. Next, an adjustment or offset value (TaperOffset) is calculated, where the adjustment value rolls off to the extent the ramped spectral gain value (RampSpGain) exceeds a threshold value (MaxThresh). As depicted in FIG. 6, if the ramped spectral gain signal (RampSpGain) is below the threshold value (as determined at step 624), then a constant offset value (ConstOffset) may be added to the spectral gain signal (RampSpGain), as shown at steps 626 and 634. However, if the ramped spectral gain signal (RampSpGain) exceeds the threshold value (as determined at step 624), the adjustment value is tapered off. The tapering calculation can be implemented in any of a variety of ways, but as shown at step 628, tapering is accomplished by subtracting from the constant offset value (ConstOffset) the product of the slope with which the RampSpGain is tapered off (TaperSlope) and the difference between the spectral gain signal (RampSpGain) and the threshold value (MaxThresh). The tapered value is set to a minimum value of zero (steps 630, 632), and is then added to the spectral gain signal (RampSpGain), as shown at step 634, to generate the final value for the spectral gain control signal (TaperSpGain).

These are but illustrative examples of using a tapered clamping technique in combination with a ramped offset to provide a triangular offset for the control signal (whether for the spectral compressor or the wideband gain stage) so that digital encoder more closely matches the BTSC standard as specified in the FCC OET-60 document, at low frequencies. As described herein, the triangular offset adjustment to the gain control signal is designed to enhance the digital encoding process to match the differing amounts of noise energy found in an analog BTSC encoder designed to conform to the BTSC standard specified in the FCC OET-60 document. Other compensation techniques can be used in accordance with the present invention to compensate for noise found in the analog encoding process by effectively inserting digital noise in the BTSC encoder through feedback control signal adjustments.

Figure 7:
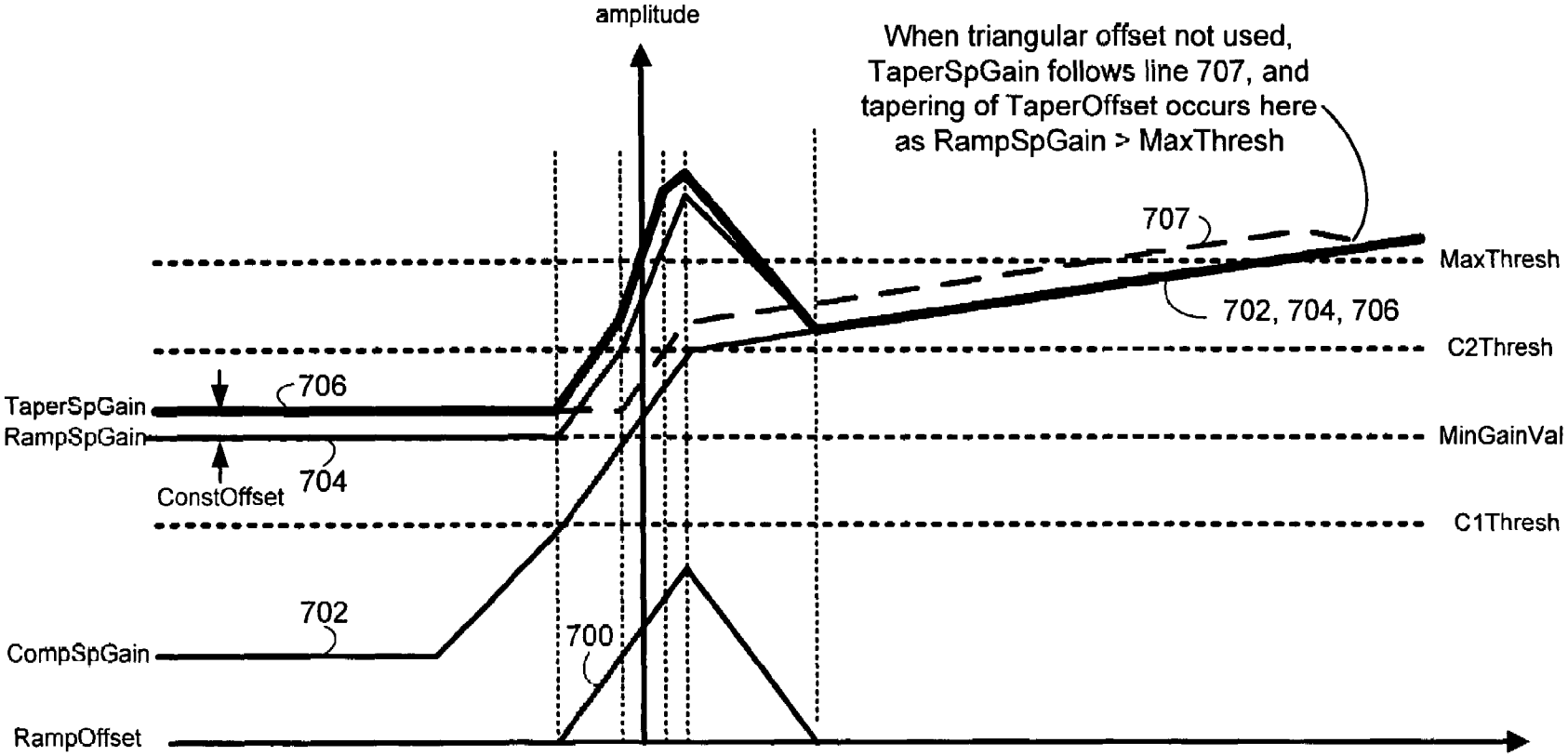
FIG. 7 graphically depicts a spectral gain clamp/offset calculation for a control signal.

FIG. 7 illustrates how the adjustments to the spectral compressor control signal may be generated in accordance with an embodiment of the present invention. In this illustration, both the spectral gain and the offsets (e.g., ConstOffset) are assumed to be positive values, and the depicted slope values are for illustration purposes only. As depicted, the final value for the spectral gain control signal 706 (TaperSpGain) is determined by the amplitude of the computed spectral gain value 702 (CompSpGain) in relation to the various specified threshold values (C1Thresh, C2Thresh, etc). By clamping the final value 706 (TaperSpGain) so that the clamping effect is observed only at low frequencies (i.e., below 2 kHz) and then selectively adding offset values as the gain control signal 702 increases through predetermined threshold values, improved stereo separation at the low frequencies is obtained.

In the example of FIG. 7, the final value 706 (TaperSpGain) is depicted as being clamped to a minimum gain value plus a constant offset when the computed spectral gain control signal 702 is below a first threshold value corresponding to the C1Thresh amplitude value. As illustrated, the compensation technique just compensates for different values (amplitudes) of CompSpGain. Hence, it should strictly have only one axis (vertical only). To provide a better conceptual feel for the compensation technique, it has been spread out horizontally as CompSpGain increases in value. When the computed spectral gain control signal 702 exceeds the first threshold value, a ramp offset 700 is added as a component of the final value 706. When the amplitude of the computed spectral gain control signal 702 exceeds minimum gain value, the final value 706 is the sum of the computed spectral gain control signal 702, the ramp offset 700 and the fixed offset (ConstOffset), until the amplitude of the ramped control signal 704 exceeds the maximum threshold (MaxThresh), at which time the fixed offset (ConstOffset) begins to taper down to zero. Because the tapered offset and ramped offset waveform 700 reach zero, the final value 706 (TaperSpGain) tracks the computed spectral gain control signal 702. Alternatively, spectral gain control signal 707 illustrates another embodiment where a triangular offset is not used, in which the TaperSpGain signal 707 tapers off as the RampSpGain signal 704 exceeds the MaxThresh value.

In accordance with the present invention, control signal compensation is provided to address mismatch in the noise characteristics in the various bands of audio frequencies between the digital encoder and an analog encoder that conforms to OET-60 standard. This can be verified by driving the output of a digital encoder into an analog decoder (that conforms to the FCC OET-60 standard). Such verification assumes that an analog decoder performs the exact opposite function of an analog encoder that conforms to FCC OET-60 standard. As will be appreciated, the wideband gain control signal (WB GAIN 341) for the wideband compressor feedback loop can also be compensated in a manner similar to the techniques described above for adjusting the spectral gain control signal. According to the BTSC standard, the wideband gain applied to the audio input signal of a BTSC encoder is dynamically adjusted based on an estimate of the average energy of that signal within a specified frequency band. This process is referred to as "wideband amplitude companding," and it is controlled through a feedback loop called the "wideband feedback loop." The high frequency content of the audio input signal is also dynamically adjusted based on an estimate of the average energy of that signal within another specified frequency band. This process is referred to as "spectral companding," and it is controlled through a feedback loop called the "spectral feedback loop."

As will be appreciated, various techniques and algorithms can be used to generate and adjust final gain control signal waveform. For example, the compensation technique depicted in FIG. 7 is based on a piece-wise linear addition of extra values or "offsets" to the computed spectral gain. The disclosed compensation algorithms and the techniques used to adjust the spectral compressor control signal are not the only ways to achieve better performance. The piece-wise linear addition step has been illustrated, but other adjustment techniques can be used to achieve compensation. For example, more complex methods of compensation (such as table lookup methods of offset computation) could be employed if the situation demands wherein the BTSC encoder and a decoder (that conforms to the FCC OET-60 standard) do not appear to be matched in the SP GAIN and the WB GAIN. The complex methods may involve subtraction or addition of offsets or may involve division or multiplication of offsets across various values of the two gains or some table-based lookup schemes or function generation schemes across various values of the two gains.

Figure 8:
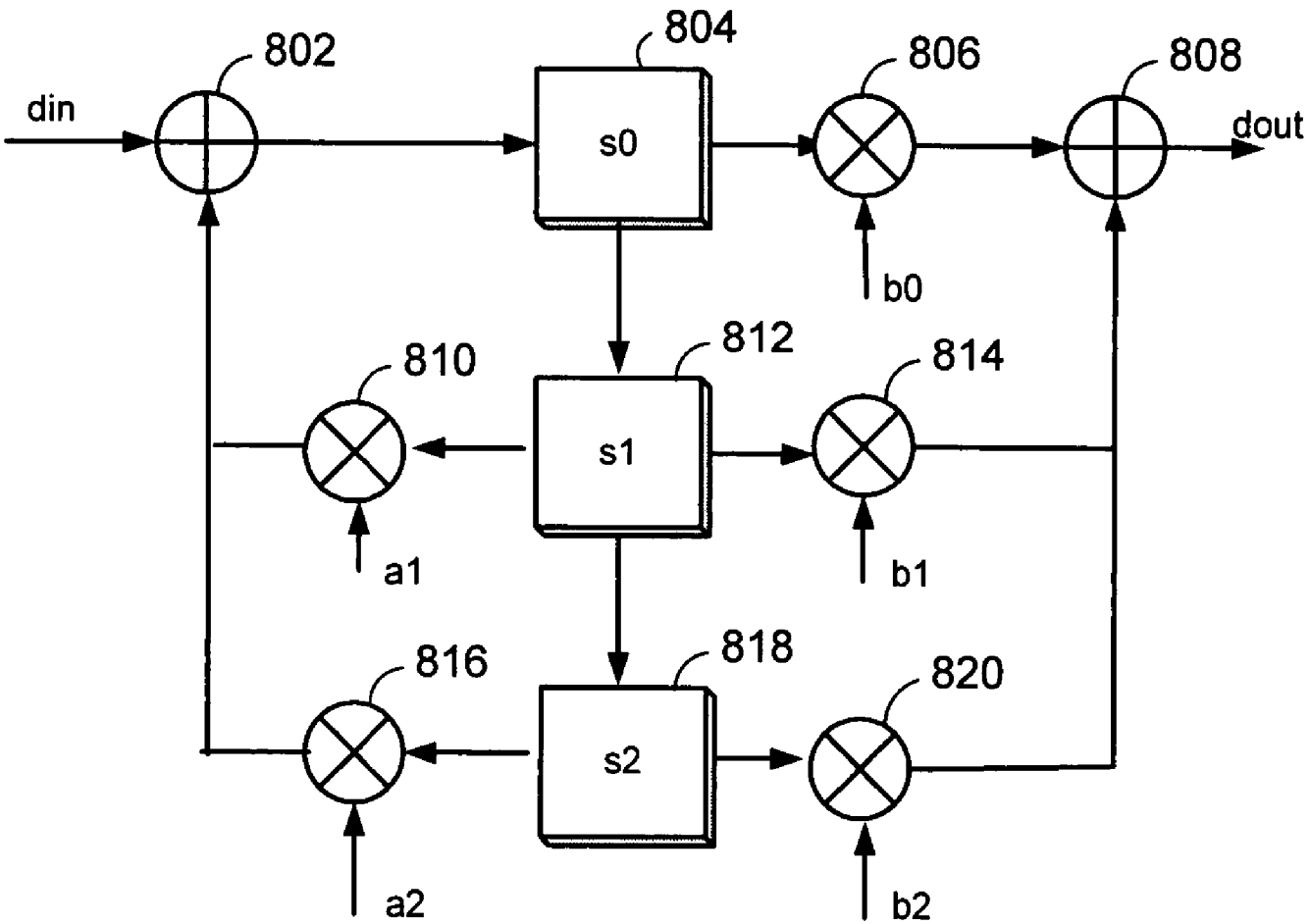
FIG. 8 depicts an IIR filter structure.

In a selected embodiment, the input low-pass Cauer filters 302, preemphasis filters 304, output low-pass Cauer filters 310, low-pass filters 318, 338, bandpass filters 314, 334 and spectral compressor 308 have different numbers of taps and complexity, but they all follow the basic infinite impulse response filter structure 800 shown in FIG. 8. The boxes labeled s0 (804), s1 (812), and s2 (818) refer to delay elements. And the feedback coefficient taps are referred to as a1 (810), a2 (816), etc. The feed forward coefficients are referred to as b0 (806), b1 (814), b2 (820), etc.

Figure 9:
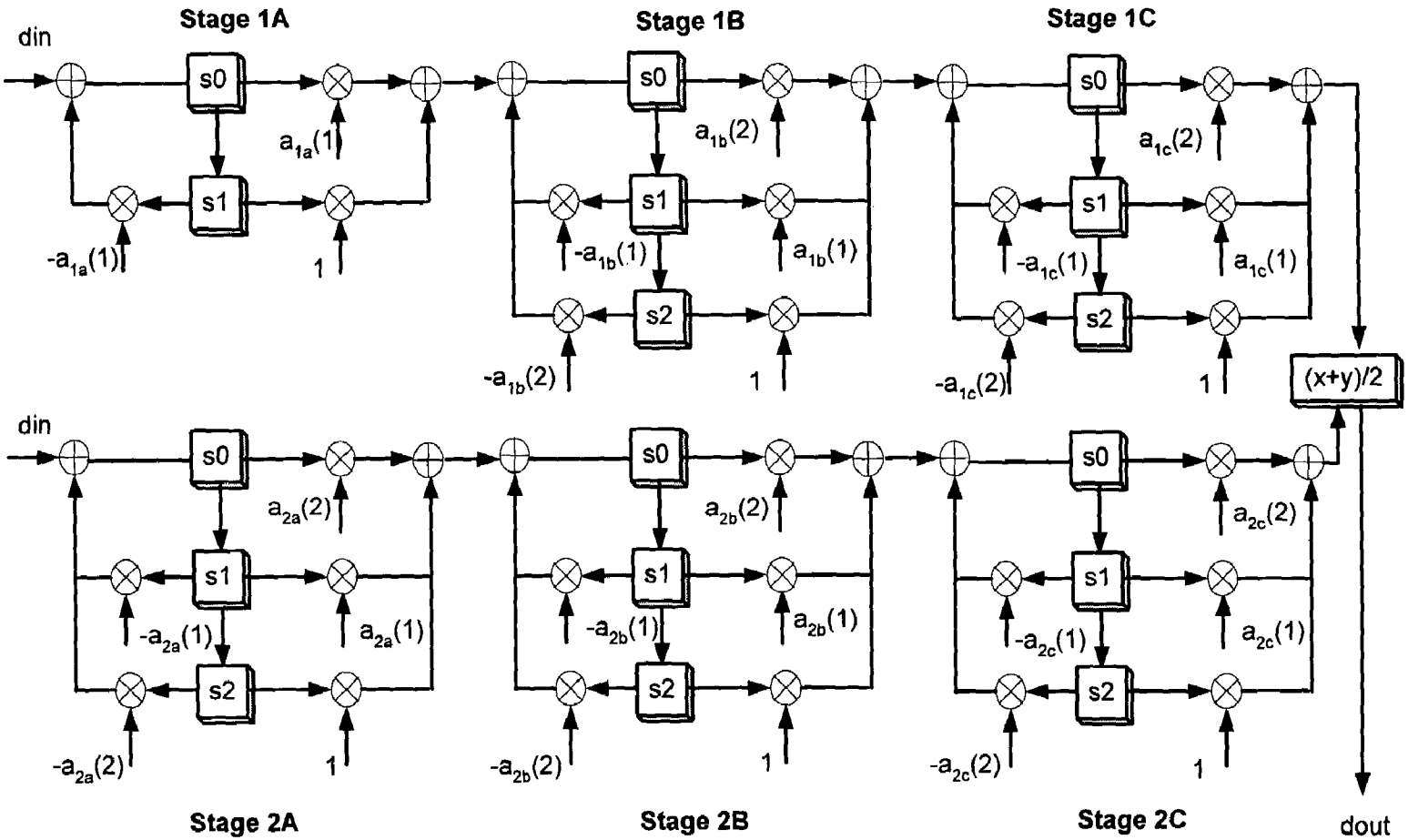
FIG. 9 depicts an eleventh order elliptical Cauer filter implemented using an allpass decomposition.

The most complex IIR filter in the BTSC encoder are the input and output low pass filters 302 and 310. For example, an eleventh order elliptical Cauer filter 900, which is implemented using the allpass decomposition, is shown in FIG. 9. The labeling of the feedback coefficients (an), feed forward coefficients (bn) and delay elements (sn) is as described in FIG. 8 (where 'n' can be an element from the set {1*a*, 1*b*, 2*a*, 2*b*, 1*c*, 2*c*}. The filter implementation uses five second-order stages (stages 1B, 1C, 2A, 2B and 2C) and one first order stage (stage 1A), where each stage is an all-pass filter. The cascading of all-pass stages (with unity gain) help in containing word-length growth from one stage to the next.

The compensation technique of the present invention may not be restricted to a digital implementation of the encoder. For example, the disclosed techniques for generating and adjusting a final gain control signal waveform can also be implemented in an analog encoder to ensure performance compliance with the FCC OET-60 BTSC MTS standard.

The above described compensation techniques for the SP GAIN and the WB GAIN signals assume that the rest of the encoder blocks are implemented to comply with the definitions/requirements of the BTSC standard. In implementing the various blocks of the encoder, any departure from that specified in the standards to realize a compensation technique for the SP GAIN and WB GAIN so as to achieve compliance to the FCC OET-60 BTSC MTS standard in an encoder is also claimed to be within the scope of this invention.

The BTSC MTS standard allows a separate audio channel called the SAP (Second Audio Program) to be BTSC encoded and transmitted along with the signals used for stereo mode of operation. The computations required are exactly similar to those required for the difference channel.

In one particular embodiment of the BTSC encoder, the filters and gain stages used for the difference channel processor can also be used by the SAP channel processor. In this embodiment of the encoder, the difference channel processing is not done when the SAP channel processing is done. Similarly, if the difference channel processing is done, the SAP channel processing is not done. FIG. 3 shows such an embodiment of a BTSC encoder. In FIG. 3, the multiplexer 365 is used to bypass the subtractor 363, and pass the output of the right volume control multiplier to the input of the fixed preemphasis filter 367. The modulation block of 354 FM modulates the input 352 (which is produced by the SAP channel processor) with a carrier wave of frequency equal to five times the pilot frequency. The sum channel processor (consisting of the 75 μsecond preemphasis filter 366 and the LOCF 370) can still receive input from multiplexer 364. This multiplexer is configured to bypass the adder 362 and pass the output of the left volume control multiplier 360 to the 75 μsecond preemphasis filter. In this embodiment, the left input 303 can be the mono channel and the right input 305 can be the SAP channel.

As will be appreciated, the difference channel processing section used in the stereo mode of encoder operation (consisting or blocks of 361, 320, 340, 332, 308, 306, 367, 371) may be duplicated and called the SAP channel processor. In this case, the encoder receives three inputs. They are L (left/audio-channel 1) 303, R (right/audio-channel 2) 305, and S (SAP/audio-channel 3). The S input goes through its own input low pass filter similar to the R filter of 302. It will have its own volume control register. Such an embodiment of the encoder can simultaneously encode stereo (comprising of left and right audio channels and SAP audio channel).

It will be appreciated that the compensation technique of adjusting the wideband gain and spectral gain used to achieve BTSC standard compliance of the encoder for the stereo mode of operation may also be employed for the SAP channel processor to realize BTSC standard compliance for the SAP encoding. The exact details of compensation may include the clamp, additive offset, and/or the ramp offset schemes. Note, however, that the values of the offsets used in the SAP channel processor may be different from those used in the difference channel processor. These values will be such that the output of the encoder complies with the requirements of SAP encoding in the BTSC MTS standard. In addition, for SAP encoding, the input and the output low pass filters used for SAP processor may be programmed to bandlimit the signals to approximately below 10-15 kHz.

In accordance with the disclosed encoder, modulator 354 performs AM-DSB-SC (Amplitude modulation double sideband suppressed carrier) modulation using a carrier wave (sine or cosine) having a frequency that is twice that of the pilot frequency for the difference channel processor output during stereo operation. In addition, modulator 354 performs FM (frequency modulation) modulation using a carrier wave of frequency equal to five times the pilot frequency for the SAP channel processor output during SAP mode of operation of the encoder.

While the system and method of the present invention has been described in connection with the preferred embodiment, it is not intended to limit the invention to the particular form set forth, but on the contrary, is intended to cover such alternatives, modifications and equivalents as may be included within the spirit and scope of the invention as defined by the appended claims so that those skilled in the art should understand that they can make various changes, substitutions and alterations without departing from the spirit and scope of the invention in its broadest form.

What is claimed is:

1. A digital BTSC signal encoder for encoding first and second digital audio signals with adjustments to conform to the BTSC MTS standard, said encoder comprising:

(A) an input matrix for receiving said first and second digital audio signals comprising an adder for summing said first and second digital audio signals to generate a digital sum signal, and a subtractor for subtracting the second digital audio signal from the first digital audio signal to generate a digital difference signal;

(B) sum channel processor comprising a first digital filter for digitally processing said digital sum signal; and (C) difference channel processor comprising a second digital filter for digitally processing said digital difference signal, further comprising a spectral compressor and a spectral feedback loop for generating a spectral gain control signal that is used to generate a first control signal that is input to the spectral compressor and that is clamped so that the first control signal does not go below a minimum value;

wherein the digital BTSC encoder operates at a sample rate that is at least substantially ten times the bandwidth of the first and second digital audio signals so that said digital filters in the sum channel processor and the difference channel processor substantially match BTSC analog filter transform functions in both magnitude and phase.

2. The digital BTSC signal encoder of claim 1, wherein the input matrix comprises a first input low-pass filter for filtering the first digital audio signal and a second input low-pass filter for filtering the second digital audio signal, where the first and second input low-pass filters are each characterized by a cutoff frequency that is less than or equal to approximately 15-20 kHz.

3. The digital BTSC signal encoder of claim 2, wherein the first and second input low-pass filters are each characterized by a stop-band attenuation of substantially 50-70 dB.

4. The digital BTSC signal encoder of claim 1, wherein the input matrix, sum channel processor and difference channel processor are formed together on a common substrate.

5. The digital BTSC signal encoder of claim 4, wherein the substrate is silicon.

6. The digital BTSC signal encoder of claim 4 wherein the input matrix, sum channel processor and difference channel processor are fabricated according to standard CMOS processing.

7. The digital BTSC signal encoder of claim 1, wherein the first control signal is offset from the spectral gain control signal by a first offset value.

8. The digital BTSC signal encoder of claim 7, wherein the first offset value tapers off as the first control signal exceeds a first threshold value.

9. The digital BTSC signal encoder of claim 7, wherein the first offset value includes a positive or negative ramp offset value when the first control signal is between a first threshold value and a second threshold value.

10. The digital BTSC signal encoder of claim 1, wherein the first control signal is clamped to a minimum value when the spectral gain control signal is below a first threshold value and is equal to the spectral gain control signal when the spectral gain control signal is above a second threshold value, and wherein the first control signal comprises a triangular offset component when the spectral gain control signal is between the first threshold value and the second threshold value.

11. A digital integrated circuit BTSC signal encoder, comprising:

(A) matrix means for receiving a digital left channel audio signal and a digital right channel audio signal, and including means for summing said digital left and right channel audio signals and thereby generating a digital sum signal, and including means for subtracting one of said digital left and right channel audio signals from the other of said digital left and right channel audio signals and thereby generating a digital difference signal;

(B) sum channel processing means for processing said digital sum signal; and (C) difference channel processing means for digitally processing said digital difference signal, said digital channel processing means comprising a gain stage and a feedback loop for generating a selectively adjustable control signal input to the gain stage, wherein the control signal is selectively adjusted to clamp the control signal from going below a minimum value;

wherein the digital BTSC encoder operates at a sample rate so that said sum channel processing means and the difference channel processing means substantially match BTSC analog filter transform functions in both magnitude and phase.

12. The BTSC signal encoder of claim 11, wherein the gain stage comprises a wideband gain stage, and the control signal comprises a wideband gain control signal.

13. The BTSC signal encoder of claim 11, wherein the gain stage comprises a spectral compressor, and the control signal comprises a spectral gain control signal.

14. The BTSC signal encoder of claim 11, wherein the clamped control signal is selectively adjusted by adding an offset value.

15. The BTSC signal encoder of claim 14, wherein the offset value tapers off as the clamped control signal exceeds a first threshold value.

16. The BTSC signal encoder of claim 14, wherein the clamped control signal is selectively adjusted by adding a ramped offset when the clamped control signal exceeds a first threshold value.

17. A method for controlling low frequency stereo separation for a digital BTSC encoder by adjusting a gain control signal in a feedback loop of the BTSC encoder, comprising:

clamping the gain control signal at a minimum value when the gain control signal amplitude is below a first threshold value to form a clamped gain control signal; and adding a tapered offset to the clamped gain control signal that rolls off to zero when the gain control signal equals a second threshold value to form a tapered gain control signal, where the second threshold value defines a region of operation for the BTSC encoder where the gain control signal is dominated by noise.

18. The method of claim 17, further comprising adding a triangular offset to the tapered gain control signal when the value of the gain control signal is between the first threshold value and a second threshold value.

19. The method of claim 17, wherein the gain control signal comprises a wideband gain control signal.

20. The method of claim 17, wherein the gain control signal comprises a spectral gain control signal.

21. A BTSC signal encoder for encoding first and second audio signals with adjustments to conform to the BTSC MTS standard, said encoder comprising:

(A) a matrix for receiving said first and second audio signals comprising an adder for generating a sum signal, and a subtractor for generating a difference signal;

(B) sum channel processor for processing said sum signal; and (C) difference channel processor for processing said difference signal, further comprising a spectral compressor and a spectral feedback loop for generating a spectral gain control signal that is used to generate a first control signal that is input to the spectral compressor and that is clamped so that the first control signal does not go below a minimum value.

22. The BTSC signal encoder of claim 21, wherein the encoder is implemented as a digital BTSC encoder.

23. The BTSC signal encoder of claim 21, wherein the encoder is implemented as an analog BTSC encoder.

24. A BTSC encoder for encoding first and second audio signals with adjustments to conform to the BTSC MTS standard, said encoder comprising:

(a) a matrix for receiving said first and second audio signals comprising an adder for generating a sum signal, and a subtractor for generating a difference signal;

(b) sum channel processor comprising a first digital filter for digitally processing said sum signal;

(c) difference channel processor with spectral gain feedback adjustment and wideband gain feedback adjustment so that the difference channel processor complies with the requirements of the BTSC MTS standard; and (d) a bypass circuit for optionally bypassing the adder and the subtractor in the matrix to pass the first and second audio signals directly to the sum channel processor and difference channel processor.

25. The BTSC encoder of claim 24, wherein the first audio signal input to the matrix is sent to the sum channel processor and the second audio signal is sent to the difference channel processor.

26. The BTSC encoder of claim 24, wherein the first audio signal input to the matrix is sent to the difference channel processor and the second audio signal is sent to the sum channel processor.

27. The BTSC encoder of claim 24, wherein the difference channel processor comprises a second digital filter that is used during SAP audio processing.

28. A BTSC signal encoder for encoding first, second and third audio signals with adjustments to conform to the BTSC MTS standard, said encoder comprising:

(a) a matrix for receiving first and second audio signals comprising an adder for generating a sum signal, and a subtractor for generating a difference signal;

(b) sum channel processor;

(c) a difference channel processor with a first spectral gain adjustment and wideband gain adjustment so that difference channel processing of the difference signal complies with the requirements of the BTSC MTS standard; and (d) a SAP channel processor for processing the third audio signal with a second spectral gain adjustment and wideband gain adjustment so that the SAP channel processing of the third audio signal complies with the requirements of the BTSC MTS standard.

* * * * *